US006761090B2

(12) United States Patent
Dagenais et al.

(10) Patent No.: US 6,761,090 B2
(45) Date of Patent: Jul. 13, 2004

(54) CAMMING SYSTEM FOR POWER TONG JAWS

(76) Inventors: Dan Dagenais, 1620 Welborne Cove, Edmonton, Alberta (CA), T6M 2M5; Leslie L. Szalacsi, R.R. 3, Ononway, Alberta (CA), T0E 1V0; Jonathan B. Fraser, 21 Morgan Crescent, St. Albert, Alberta (CA), T8N 2E1; Hermann Basler, Box 2162, Stony Plain, Alberta (CA), T7Z 1X7

( * ) Notice: Subject to any disclaimer, the term of this patent is extended or adjusted under 35 U.S.C. 154(b) by 0 days.

(21) Appl. No.: 10/265,644

(22) Filed: Oct. 8, 2002

(65) Prior Publication Data

US 2004/0065174 A1 Apr. 8, 2004

(51) Int. Cl.[7] ..... B25B 13/50
(52) U.S. Cl. ..... 81/57.18; 81/57.21
(58) Field of Search ..... 81/57.15–57.21

(56) References Cited

U.S. PATENT DOCUMENTS

| | | | | | |
|---|---|---|---|---|---|
| 3,261,241 | A | * | 7/1966 | Catland | 81/57.18 |
| 3,847,040 | A | * | 11/1974 | Bufkin | 81/57.18 |
| 4,084,453 | A | * | 4/1978 | Eckel | 81/57.18 |
| 4,089,240 | A | * | 5/1978 | Eckel | 81/57.18 |
| 4,250,773 | A | * | 2/1981 | Haynes et al. | 81/57.18 |
| 4,836,064 | A | * | 6/1989 | Slator | 81/57.18 |
| 5,819,605 | A | * | 10/1998 | Buck et al. | 81/57.33 |

* cited by examiner

*Primary Examiner*—Joseph J. Hail, III
*Assistant Examiner*—David B. Thomas
(74) *Attorney, Agent, or Firm*—David J. French

(57) ABSTRACT

A power tong or back-up tong has a jaw assembly that is advanced into engagement with a pipe through a cam follower that contacts the camming surface on the inside circumference of a ring gear, the cam follower being in the form of a series of roller elements arranged as a circulating bearing. In a preferred form, the roller elements are cylindrical roller bearings and the jaw assembly is mounted for sliding advancement towards the pipe to be engaged.

10 Claims, 5 Drawing Sheets

CAMMING SYSTEM FOR POWER TONG JAWS

FIELD OF THE INVENTION

This invention relates to power tongs used to turn pipe in the oilfield industry. More particularly, it relates to a camming system by which the jaws within a power tong are caused to engage with pipe.

BACKGROUND TO THE INVENTION

In the oil industry power tongs are used to either grasp and hold pipe, tubing and casing while threaded joints are being made up or broken, or to rotate pipe, tubing and casing in order to make up or break such joints and to effect drilling. In the past, power tongs have been provided with at least one jaw mounted in a displaceable jaw assembly that may be shifted in order to bring the jaw into bearing engagement against pipe. Jaw systems of this design are typically constrained by upper and lower cage plates to which the jaw assembly is connected.

Typically, one or more jaws are caused to advance inwardly by rotating an outer encircling camming surface about the jaw assembly with the pipe located at the center of rotation. This camming surface is typically formed on the inside of a C-shaped ring gear. Camming rollers on the jaw assembly act as a cam follower bearing against this camming surface, and causing the jaw assembly to advance inwardly in response to the inward urging developed by the cam surface as it rotates past the camming rollers. The jaws in many typical designs pivot about a pivot axis that is fixed in relationship to the cage plates, the path followed by the jaws as they are displaced inwardly being arcuate. In other jaw designs the jaws advance radially towards the center of the tong in a sliding action.

Once the jaws have contacted the pipe, a very high level of radial force be applied to the pipe in order to ensure a non-slipping, frictional engagement persists while torque is applied to the pipe. High torque forces are required in order to ensure that the joints in the drill pipe are properly made up, and to turn the bit mounted at the bottom of the drill pipe string where the boring of the earth is occurring.

In order to torque pipe with minimal damage to the pipe surfaces very high radial forces are required when the jaws are equipped with smooth pipe-engagement surfaces. Smooth-faced gripping jaws are particularly employed with casing and tubing that are made of exotic alloys to reduce corrosion. Such high radial forces are achieved by providing a camming surface with a very gradual inwardly-directed slope along which the camming roller is required to advance. Consequently, in order to maximize the radial forces that can be applied to the pipe, it is important that the camming roller should be able to advance along the camming surface with a minimum level of frictional resistance.

An example of a prior art patent addressing this issue is U.S. Patent 5,819,605 to Buck for "Low Friction Power Tong Jaw Assembly". In this patent it is proposed to provide a friction reducing surface between a jaw roller and the surface of a roller retaining means that secures the jaw roller to an aperture in the body of the jaw assembly. Examples given include pin, ball or sleeve bearings used to support the jaw roller. However, in every case depicted, only a single roller is in contact with the camming surface. Contact occurs along a single line contact that is limited to the length of a single roller.

It would be advantageous to provide a power tong wherein the frictional resistance encountered between the jaw holder and the camming surface is reduced to a low-level. The present invention addresses that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The present invention in one aspect is applicable to a power tong provided with a powered rotary ring gear having a central pipe-containing region accessible through a throat opening in the side of the ring gear. The inner surface of the ring gear includes a generally crescent-shaped camming surface or surfaces that is/are of a minimum height adjacent to the throat, rising towards a maximum, inwardly-directed height proceeding towards the inside of the ring gear opposite to the throat.

Mounted above and below the ring gear are twin C-shaped cage plates each with a key-shaped gap. The gap in the "C" of each cage plate is comparable in size and corresponds with the central pipe containing region and throat opening in the ring gear when aligned. These cage plates are free to rotate with respect to the ring gear, but are constrained to maintain a center of rotation corresponding to the center of the ring gear and the drill pipe to be contained therein.

According to a preferred embodiment, a first, receiving jaw means is mounted between the two cage plates. The receiving jaw means is preferably in the form of a pair of pipe receiving jaws that are pivotally mounted and positioned to receive and self-center pipe that has passed through the throat in the ring gear and gaps in the cage plates to be positioned centrally within the rotary gear. While this is a preferred arrangement, any system that positions the pipe to be turned and assists in the engagement of the pipe may be employed as the receiving jaw means. This may include a second or further jaw assembly as next described below.

At least one jaw assembly incorporating a pipe-engaging jaw is also carried between the upper and lower cage plates, mounted to allow the jaw assembly to advance inwardly between the plates. With the pipe centered in place, upon rotation of the ring gear, (with the cage plate restrained), the jaw assembly is placed into alignment with the beginning of the camming surface on the ring gear. A cam follower bearing means according to the invention is mounted within the jaw assembly, positioned to contact and advance along the camming surface. Rotation of the ring gear forces the jaw within the jaw assembly to move inwardly in response to the inwardly-directed force developed by the camming surface on the cam follower. Such action continues as the ring gear is rotated until the jaw within the jaw assembly contacts the pipe. This occurs before the cam follower reaches the maximum height of the camming surface within the ring gear.

The inwardly directed force developed by the camming surface on the cam follower bearing means, or "cam follower", then causes the pipe-contacting die face of the jaw to bear tightly against the pipe. Once this tight engagement is achieved, the pipe will be forced to rotate with the ring gear. The cage plates and jaw assembly, together with the receiving jaw means, will then rotate with the pipe as well.

The cam follower of the invention is characterized by a plurality of circulating roller elements, preferably cylindrical roller bearings, that are constrained to circulate through a roller bearing passageway formed in association with the body of the jaw assembly. During a portion of their circulation, the roller elements are contained within an inner portion the roller bearing passageway while passing through the body of the jaw assembly. Their circulating path then continues along an outer bearing face of the jaw assembly, exposing the roller elements so that they are directed towards the camming surface. Further, the shape of the bearing face of the jaw assembly is curved to ensure that at least two and preferably four or more roller elements are in contact with the camming surface, in the "camming zone" of the camming surface.

The roller elements are preferably contained while on this outward portion of their path by upper and lower containment means. Such containment means may be in the form of grooved tracks set into the surfaces of containment plates The roller elements, in the case of cylindrical bearings, are conveniently maintained in parallel alignment by being tightly packed. Alternately spacers may be present between such cylindrical bearings to maintain them in parallel alignment, oriented transversely across the circulating path along which such bearings advance.

The features of the invention as described above may be incorporated into a power tong wherein the jaw assembly is mounted for pivoting advancement towards a center of the power tong. Alternately, the jaw assembly may be mounted for radial advancement towards the center of the tong. In either case, the use of multiple camming roller elements that are pressed against the camming surface while traveling in a circulating path associated with the jaw assembly serves to greatly reduce the frictional resistance to the advancement of such cam follower roller elements along the camming surface when the tong is applying torque and consequently developing high radial forces to ensure that an effective grip is maintained on the pipe.

While described in the context of a single jaw and jaw assembly being advanced inwardly, the invention may also be employed with two or more jaws having a similar cam follower system to that described, wherein the camming roller elements of each jaw assembly are each caused to advance along a corresponding camming surface within the ring gear while circulating within their respective jaw assembly.

According to a further feature of the invention, the jaw assembly is introduced into the ring gear through the throat of the tong. In this variant the jaw assembly is initially stored at a storage location on the inside face of the gate used to close the tong throat. Upon closing of this gate, the jaw assembly may be advanced by sliding it inwardly through the throat to a position within the ring gear. Thereafter, rotation of the ring gear with respect to the jaw assembly commences the camming action.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1A:
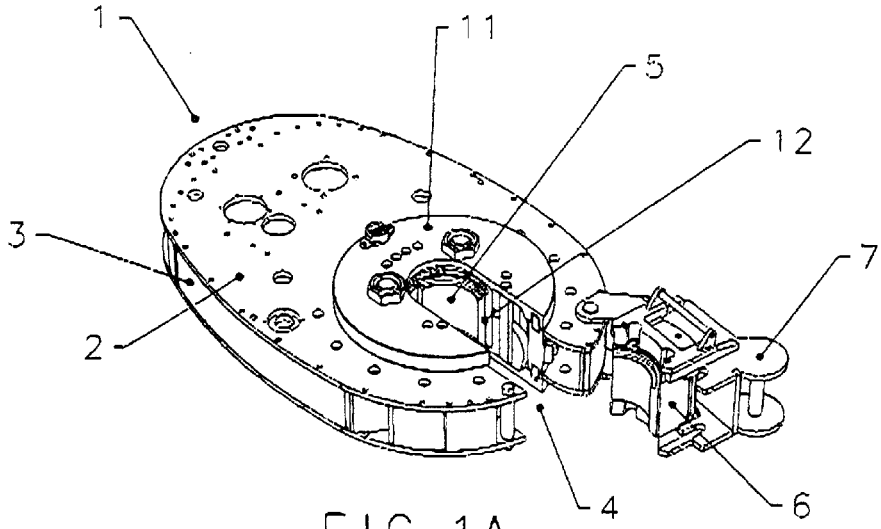
FIG. 1A is a perspective view of a power tong with a sliding jaw assembly mounted in a swiveling door or gate which, upon closure, will align and release the sliding jaw assembly for advancement into the throat of the ring gear of the tong.

In FIG. 1A a power tong 1 has a top-side covering plate 2 over a frame 3 and a throat region 4 accessing a central region 5. A sliding jaw assembly 6 is detachably mounted in a swivelling gate 7 that can be closed in order to position the sliding jaw assembly 6 for radial advancement into the throat 4. With the gate 7 open, the sliding jaw assembly 6 is conveniently stored on the gate 7. With the gate 7 closed, the sliding jaw assembly 6 is aligned to advance into the throat 4 of the tong 1.

A top-side "C"-shaped cage plate 11 with a gap 12 corresponding to the ring gear throat opening 4 surrounds the throat 4 and central region 5. A similar bottom-side cage plate (not shown) is present on the underside of the tong 1.

Figure 1B:
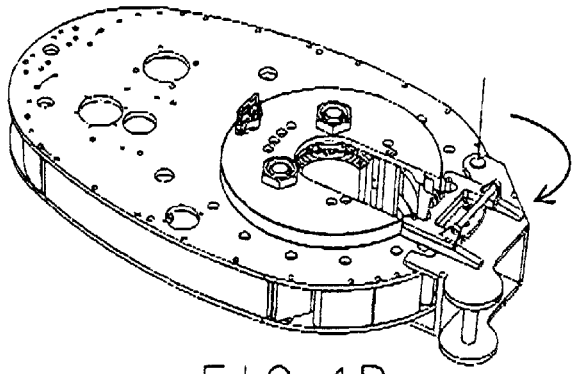
FIGS. 1B and 1C are perspective views of the power tong of FIG. 1A with the sliding jaw assembly respectively aligned for advancement into the throat of the ring gear, and fully advanced for engagement by the ring gear of the tong.
Figure 1C:
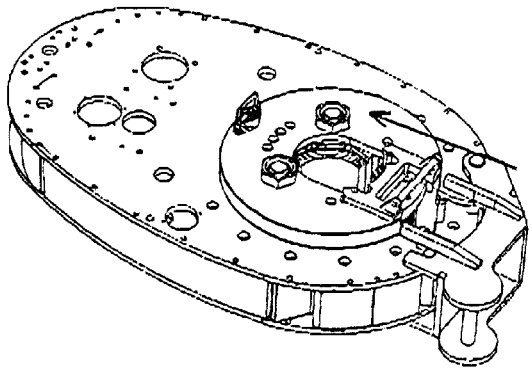
Figure 2A:
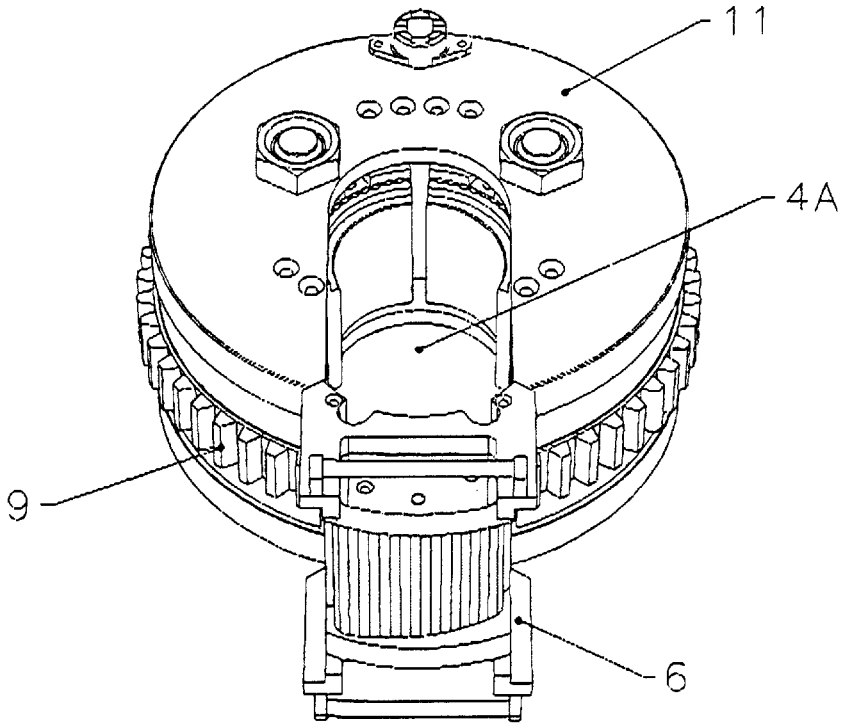
FIG. 2A is a further view of FIG. 1B taken from a perspective that is aligned with the throat on the power tong, with the outer frame, top cage plate and swivelling gate all removed for clarity.
Figure 2B:
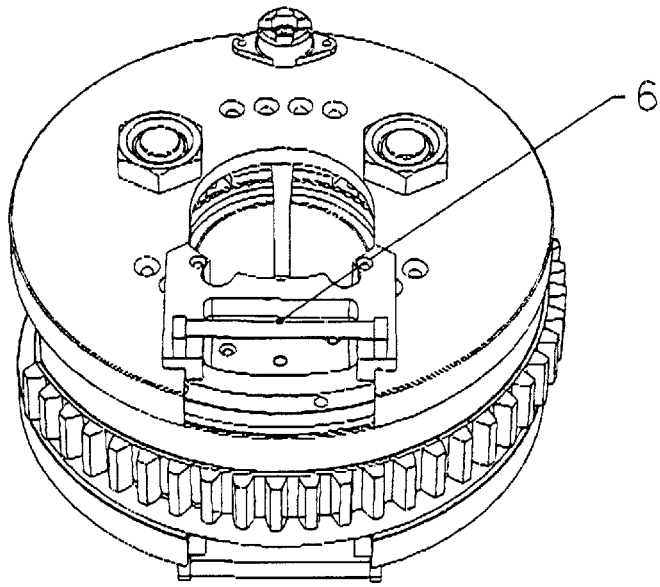
FIG. 2B is a further view of FIG. 1 taken from a perspective that is aligned with the throat on the power tong, with the outer frame, top cage plate and swivelling gate 7 all removed for clarity and the rotary gear advanced along the length of the throat.

In FIGS. 1B and 1C the swivelling gate 7 is progressively closed to align the jaw assembly 6 with the throat 4 of the power tong 1, and the jaw assembly 6 is advanced forwardly through such throat 4. The condition of FIG. 1B is repeated from a different perspective in FIG. 2A, where the swivelling gate 7 has been removed to expose the jaw assembly 6 for view. In FIG. 2B the swivelling gate 7 (not shown in this Figure) has been closed behind the jaw assembly 6 which has been advanced along the throat 4 to position the roller element portions 14 of the jaw assembly 6 inwardly of the camming surface 10 on the ring gear. The ring gear 9 has been partially rotated in this view to enclose the jaw assembly 6. The jaw pipe engaging portions of the assembly 6 as shown in FIGS. 4A–6B is dimensioned to pass through the throat 4 in the ring gear 9 and fit between the camming surface 10 and pipe 13.

Figure 3:
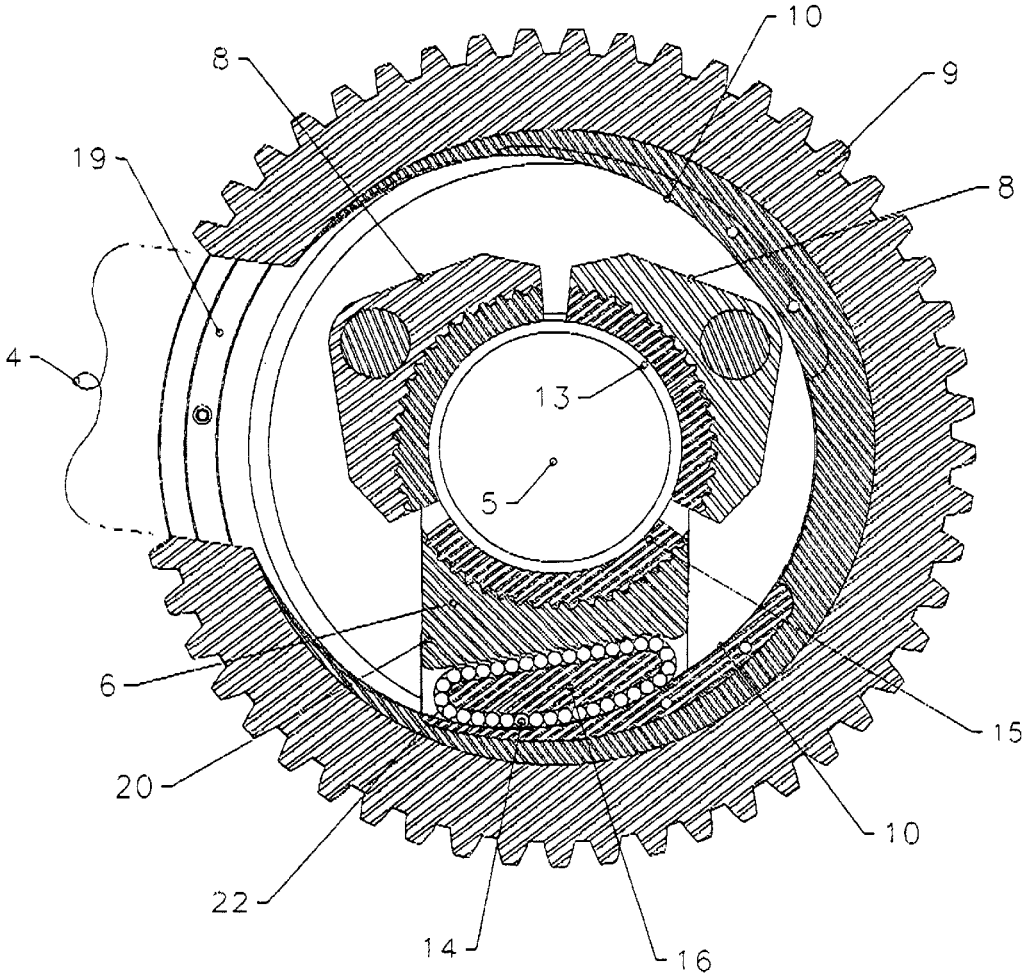
FIG. 3 is a cross-sectional plan view of the ring gear portion of the power tong of FIG. 1A with two receiving jaws and a sliding jaw assembly in place for embracing a section of pipe. The cam follower roller elements of the invention, made up of multiple roller elements in the form of hardened cylindrical rollers, are shown contained within a jaw assembly as a closed-loop, circulating bearing.

In FIG. 3 the covering plates 2, frame 3 and upper cage plate 11 are removed for clarity, exposing two pivotally mounted pipe receiving jaws 8 fitted between the two cage plates 11 to serve as a receiving jaw means for pipe 13 to be installed within the tong 1. The pipe receiving jaws 8 are pivotally mounted between the two cage plates 11. These receiving jaws 8 are positioned to receive and self-center pipe that has passed through the throat opening 4 in the ring gear 9 to be positioned centrally within the tong 1.

Contained with the frame 3 is a train of gears (not shown) that transmit power to rotate the ring gear 9. When used as a power tong, conventional actuation systems such as hydraulic motors and the like are used to engage with outer gearing around the circumferential periphery of the ring gear 9, causing it and the drill pipe 13 to rotate. When used as a back up tong, the ring gear 9 is fixed against rotation, once the pipe has been fully engaged.

An upwardly protruding "C"-shape rail (not shown) on the ring gear 9 fits into a groove (not shown) in the underside of the cage plate 11 in the known fashion to permit the cage plate 11 to rotate concentrically with respect to the ring gear 9. A similar rail and groove combination (not shown) is present on the underside of the tong 1. As the cage plates 11 are free to rotate with respect to the ring gear 9, they are constrained by the "C" shaped rail to maintain a center of rotation corresponding to the center region 5 of the ring gear 9 and the center of drill pipe 13 to be contained in the central region 5. The rail and groove may be interchanged between gear 9 and cage plate 11 to achieve the same effect In a similar fashion, a groove (not shown) in the ring gear 9 may engage with a rail 19 (FIG. 3) in the frame 3, or vice versa, stabilizing the ring gear 9 for concentric rotation. Rollers may also be used to guide the ring gear 9, in the known manner.

The ring gear 9 in FIG. 3 is provided with an inwardly advancing camming surface 10 that is, in this preferred embodiment, symmetrical about the bi-secting plane passing through the center of the throat 4. The jaw core of the assembly 6 is also shown in FIG. 3 with its cam follower elements 14 partially advanced along the camming surface 10. The inwardly directed force developed by the camming surface 10 through the cam follower or roller elements 14 causes the advancing jaw 15 to bear tightly against the pipe 13 before the roller elements 14 reach the maximum height of the camming surface 10 within the ring gear 9. Once this tight engagement is achieved, the pipe 13 will be forced to rotate with the ring gear 9.

When employed with a symmetrical, crescent shaped camming surface 10, the ring gear 9 can be rotated in either direction, allowing the jaw 15 to engage with pipe 13 for the purposes of effecting either the make-up or breaking of threaded joints. By reason of the fact that in this embodiment only one jaw 15 carries a cam follower that bears against the camming surface 10, the camming surface 10 extends for a greater extent within the ring gear 10 than is available in some prior art tongs. This permits the depth of the camming surface 10 to increase more gradually, increasing the leverage and force that may be applied to the jaw 15 to in order to ensure that it effects a non-slipping engagement with the pipe 13.

In FIG. 3 the cam follower roller elements 14 of the invention are shown encircling a supporting bearing plate 16 with an outwardly directed bearing face 16A carried by the jaw assembly 6. Such rollers 14 distribute the load developed by the camming surface 10 on the sliding jaw assembly 6 while minimizing friction for this cam follower system.

The outwardly directed bearing face portion of this bearing plate 16 is generally of a shape that will permit at least portions of it to lie at an approximately even-spaced separation from the camming surface 10 along a substantial portion of its length. The shape of the bearing plate 16 is intended to permit as many roller elements 14 as is practical to share more or less equally the inwardly directed forces that arise as the roller elements 14, and jaw assembly 6, are advanced along the camming surface 10. As the camming surface 10 may not be circular in form, the number of roller elements 14 carrying this load may vary as the rollers 14 advance along the camming surface.

Figure 4A:
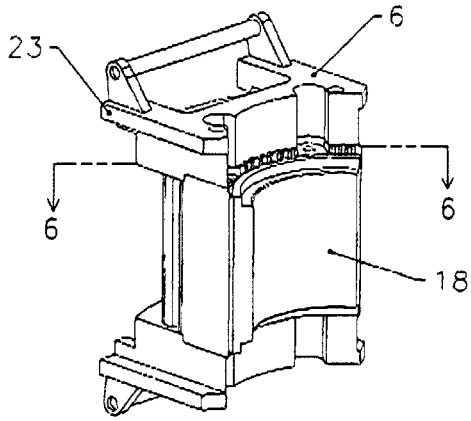
FIGS. 4A and 4B are perspective views of the sliding jaw assembly respectively showing the die plate on one side of the jaw assembly, and the array of cylindrical roller elements that constitute one example of the camming rollers of the invention on the other side of the jaw assembly.
Figure 4B:
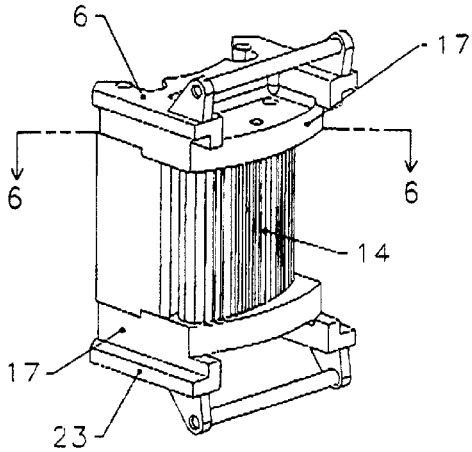

In FIG. 4A the jaw assembly 6 is shown from a view which presents the die plate 18 which is intended to contact the pipe 13. In FIG. 4B the other side of the jaw assembly 6 is shown, presenting the roller elements 14 for contact with the camming surface 10. These roller elements 14 are constrained by grooves formed between the upper and lower retainer plates 17 and the bearing plate 16 to move within their circulating path 22 within the jaw assembly 6.

Flanges 23 on the sides of the retainer plates 17 of the jaw assembly 6 engage with the sides of the gap 12 in the cage plate 11.

Figure 5:
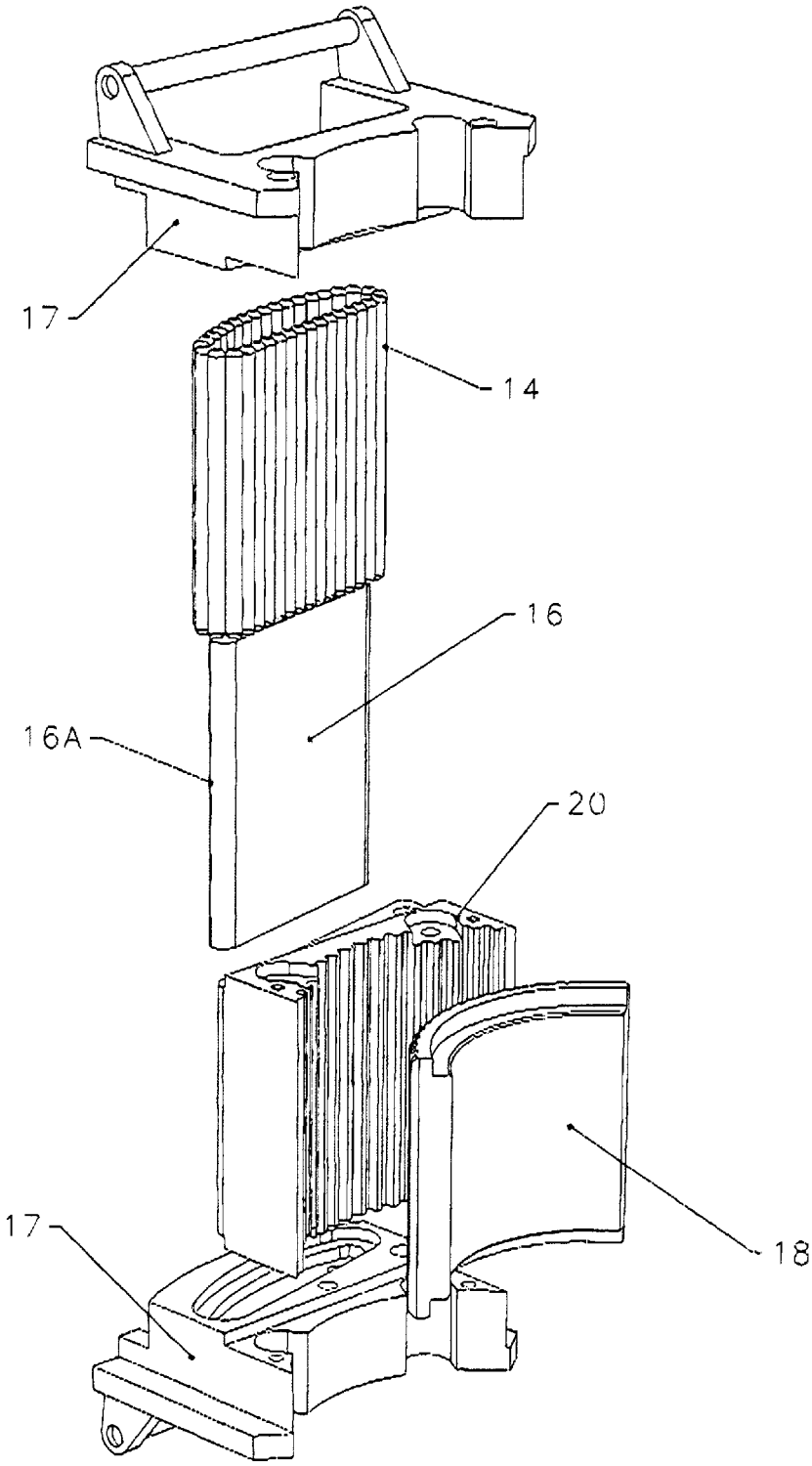
FIG. 5 is an exploded view of the jaw assembly of FIG. 4A.

In FIG. 5 the retainer plates 17 have been separated from the core body 20 of the jaw assembly 6, and the roller elements 14 displaced upwardly in an exploded view to expose the bearing plate 16 with its bearing face 16A which is otherwise retained in place by the upper and lower retainer plates 17.

Figure 6:
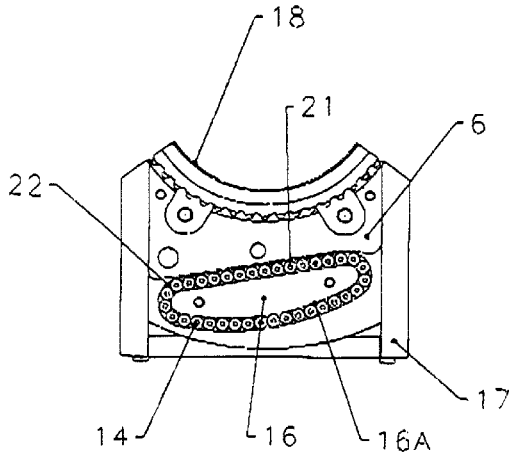
FIG. 6 is a cross-sectional plan view of the jaw assembly of FIG. 4B taken from just at the surface of the retainer plates showing the camming roller elements arrayed in a circulating form.

In FIG. 6 a portion of the jaw assembly 6 is shown with the top retainer plate 17 removed as having an optionally flat, inner, guide surface 21 along which the roller elements 14 advance, contained in this inward portion of their circulating voyage between the bearing plate 16 and the guide surface 21.

While depicted in respect of a tong with a throat 4, the sliding jaw system and further features of the invention can equally be applied to closed-mouth tongs. Similarly, while depicted as combined with a sliding jaw assembly, the invention may also be employed with one or more pivoting jaw assemblies.

CONCLUSION

The foregoing has constituted a description of specific embodiments showing how the invention may be applied and put into use. These embodiments are only exemplary. The invention in its broadest, and more specific aspects is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The Embodiments of the Invention in Which an Exclusive Property or Privilege is Claimed are Defined as Follows:

1. A power tong comprising:

(a) a ring gear having a central pipe-receiving region, the ring gear having an inner surface facing such central region;

(b) a camming surface formed on the inner surface of the ring gear;

(c) twin cage plates rotationally mounted with respect to the ring gear on opposite sides of the ring gear, said cage plates being free to rotate with respect to the ring gear, but being constrained to maintain a center of rotation substantially corresponding to the center of the ring gear;

(d) pipe receiving jaw means mounted between said cage plates and positioned to receive pipe to be positioned within the ring gear;

(e) at least one jaw assembly supported between the upper and lower cage plates and carrying a jaw positioned to bear, upon advancement towards a pipe-engaging position in the central region of the tong, against pipe to be placed therein, said jaw assembly comprising a roller bearing circulating path;

(f) a cam follower means carried by the jaw assembly and, positioned to contact and advance along the camming surface to effect advancement of the jaw into said pipe-engaging position when the ring gear is rotated with respect to the jaw assembly;

wherein the cam follower means comprises a plurality of roller bearing elements constrained to circulate in the roller bearing circulating path, said roller bearing circulating path comprising a portion which exposes some of the roller bearing elements so that they are directed towards the camming surface.

2. A power tong as in claim 1 wherein said roller bearing elements are cylindrical bearings.

3. A power tong as in claim 1 wherein said jaw assembly comprises an outer bearing face which supports the roller bearing elements against the camming surface.

4. A power tong as in claim 1 wherein at least two roller bearing elements are in contact with the camming surface as the jaw is advanced into said pipe engaging position.

5. A power tong as in claim 4 wherein at least four roller bearing elements are in contact with the camming surface as the jaw is advanced into said pipe engaging position.

6. A power tong as in claim 1 wherein the jaw assembly is slideably mounted between the cage plates.

7. A power tong as in claim 1 wherein the jaw assembly is pivotably mounted between the cage plates.

8. For a power tong having a cam ring surface, an improved power jaw comprising:

a) a jaw body having a roller bearing circulating path;

b) a plurality of roller bearing elements positioned in said circulating path; and c) means to constrain said roller bearing elements within said circulating path, wherein some of the roller bearing are outwardly exposed for engagement with a power tong camming surface.

9. A power tong as in claim 8 wherein said roller bearing elements are cylindrical bearings.

10. A power tong as in claim 9 wherein said jaw assembly comprises an outer bearing face which supports the roller bearing elements against the camming surface.

* * * * *